US006082150A

United States Patent [19]

Stucker

[11] Patent Number: 6,082,150

[45] **Date of Patent: *Jul. 4, 2000**

[54] SYSTEM FOR REJUVENATING PRESSURIZED FLUID SOLVENTS USED IN CLEANING SUBSTRATES

[75] Inventor: John F. Stucker, Scottsdale, Ariz.

[73] Assignee: R.R. Street & Co. Inc., Naperville, Ill.

[ * ] Notice: This patent is subject to a terminal disclaimer.

[21] Appl. No.: 09/364,402

[22] Filed: Jul. 30, 1999

Related U.S. Application Data

[62] Division of application No. 09/014,197, Jan. 27, 1998, Pat. No. 5,937,675, which is a division of application No. 08/680,909, Jul. 12, 1996, Pat. No. 5,772,783, which is a continuation of application No. 08/506,508, Jul. 25, 1995, abandoned, which is a continuation-in-part of application No. 08/336,588, Nov. 9, 1994, abandoned.

[51] Int. Cl.[7] ..... D06F 43/08; B08B 13/00

[52] U.S. Cl. ..... 68/18 R; 68/18 C; 68/18 F; 134/108; 134/109

[58] Field of Search ..... 134/2, 11, 12, 134/108, 109; 210/806, 167, 774; 68/18 R, 18 F, 18 C

[56] References Cited

U.S. PATENT DOCUMENTS

| | | | |
|---|---|---|---|
| 1,995,064 | 3/1935 | Hetzer | 68/18 R |
| 2,011,083 | 8/1935 | Sando | 68/18 R |
| 2,053,103 | 9/1936 | Passar | 68/18 R |
| 2,070,204 | 2/1937 | Hetzer | 68/18 C X |
| 2,114,776 | 4/1938 | Davis | 68/18 R |
| 2,140,623 | 12/1938 | Hetzer | 68/18 R X |
| 3,542,200 | 11/1970 | Durr . | |
| 4,012,194 | 3/1977 | Maffei . | |
| 4,513,590 | 4/1985 | Fine . | |
| 4,630,625 | 12/1986 | Capella et al. . | |
| 4,770,197 | 9/1988 | Prisco, Jr. et al. | 134/109 |
| 4,824,487 | 4/1989 | Heffernan . | |
| 5,013,366 | 5/1991 | Jackson . | |
| 5,068,040 | 11/1991 | Jackson . | |
| 5,073,203 | 12/1991 | Al-Ghatta . | |
| 5,201,960 | 4/1993 | Starov . | |
| 5,213,619 | 5/1993 | Jackson et al. . | |
| 5,236,602 | 8/1993 | Jackson . | |

(List continued on next page.)

FOREIGN PATENT DOCUMENTS

| | | |
|---|---|---|
| 0518653 | 12/1992 | European Pat. Off. . |
| 0530949 | 3/1993 | European Pat. Off. . |
| 3904514 | 8/1990 | Germany . |
| 4004111 | 8/1990 | Germany . |
| 3122598 | 5/1991 | Japan . |
| 1408263 | 10/1975 | United Kingdom . |
| 9401227 | 1/1994 | WIPO . |
| 9406163 | 1/1994 | WIPO . |

OTHER PUBLICATIONS

International Search Report of Application No. PCT/US 95/14643, dated Apr. 1, 1996.

*Primary Examiner*—Philip R. Coe
*Attorney, Agent, or Firm*—Mayer, Brown & Platt

[57] ABSTRACT

Method and system of rejuvenating pressurized fluid solvents used for cleaning a substrate in a pressurized vessel. A primary flow of the pressurized fluid solvent is continuously cycled from the pressurized vessel through a series of filters to remove insoluble and soluble contaminants, and then returned to the pressurized vessel. A secondary flow of the pressurized fluid solvent, preferably equivalent to less than about 40% of the primary flow, is directed either continuously or intermittently during the cleaning operation to an evaporator to evaporate the pressurized fluid solvent of the secondary flow into a vapor and to separate contaminants therefrom. The vapor from the evaporator is then either liquified by a compressor or condenser to create rejuvenated pressurized fluid solvent and redirected to the pressurized vessel for further use, or vented to atmosphere and replaced by new pressurized fluid solvent from a supply tank. Pressure equalization lines extend between a storage tank and various system components to allow solvent vapor to displace therebetween.

18 Claims, 2 Drawing Sheets

U.S. PATENT DOCUMENTS 5,267,455 12/1993 Dewees et al. .
5,269,850 12/1993 Jackson .
5,279,615 1/1994 Mitchell et al. .
5,306,350 4/1994 Hoy et al. .
5,312,365 5/1994 Firth et al. .
5,313,965 5/1994 Palen .
5,316,591 5/1994 Chao et al. .
5,339,844 8/1994 Stanford, Jr. et al. .
5,344,493 9/1994 Jackson .
5,348,588 9/1994 Winston .
5,368,171 11/1994 Jackson .
5,403,621 4/1995 Jackson et al. .
5,412,958 5/1995 Iliff et al. .

SYSTEM FOR REJUVENATING PRESSURIZED FLUID SOLVENTS USED IN CLEANING SUBSTRATES

This is a divisional of U.S. patent application Ser. No. 09/014,197, filed on Jan. 27, 1998, issued as U.S. Pat. No. 5,937,675, which is a divisional of U.S. patent application Ser. No. 08/680,909, filed Jul. 12, 1996, issued as U.S. Pat. No. 5,772,783, which is a continuation of U.S. patent application Ser. No. 08/506,508, filed Jul. 25, 1995, now abandoned, which is a continuation-in-part of U.S. patent application Ser. No. 08/336,588, filed Nov. 9, 1994, now abandoned. The entire disclosures of Serial Nos. 09/014,197, 08/680,909, 08/506,508, and 08/336,588 are incorporated herein by reference.

BACKGROUND OF THE INVENTION

1. Field of the Invention

The present invention relates to a method and system for rejuvenating pressurized fluid solvents used in cleaning fabrics, delicate electronic components, and similar sensitive substrates that may be adversely affected by soluble and insoluble contaminants entrained in the solvent. Particularly, the present invention is directed to a method and system for rejuvenating pressurized fluid solvents, such as liquid, subcritical, or supercritical carbon dioxide, without requiring 100% of the solvent to be vaporized for removal of contaminants, so as to reduce costs and adverse environmental impact.

2. Description of Related Art

A variety of methods and systems are known for cleaning fabrics, delicate electronic components, and similar sensitive substrates. These known methods and systems typically use water, perchloroethylene, petroleum, and other low pressure liquid solvents for cleaning the desired substrate.

Such conventional methods and systems generally have been considered satisfactory for their intended purpose. Recently, however, the desirability of employing these conventional methods and systems has been questioned due to environmental, hygienic, occupational hazard, and waste disposal concerns, among other things. For example, perchloroethylene frequently is used as a solvent to clean delicate substrates, such as garments and similar fabrics in a process referred to as "dry cleaning." Some locales require that the use and disposal of this solvent be regulated by environmental agencies, even when only small amounts of this solvent are to be introduced into waste streams. Such regulation results in increased costs to the user, which in turn, are passed to the ultimate consumer. It is therefore advantageous to provide a method and system for cleaning substrates utilizing a solvent having less adverse consequence than those solvents typically used.

In this regard, the use of alternative pressurized liquid or dense fluid solvents has been suggested for cleaning various substrates, wherein dense fluids are widely understood to encompass gases that are pressurized to either subcritical or supercritical conditions so as to achieve a liquid or a supercritical fluid having a density approaching that of a liquid. In particular, some patents have disclosed the use of a solvent such as carbon dioxide that is maintained in a liquid state or either a subcritical or supercritical condition for cleaning such substrates as clothing and precision metal parts.

As one example, expired U.S. Pat. No. 4,012,194 issued to Maffei discloses a garment cleaning process that uses liquid carbon dioxide. After passing through the garment, the liquid carbon dioxide solvent is circulated through an evaporator for removal of impurities, and then condensed by a refrigerated storage unit before being returned for further use.

Later patents modify the Maffei approach. Particularly, U.S. Pat. No. 5,316,591, issued to Chao et al., is directed to a method of cleaning a substrate by cavitating a liquified gas, such as liquid carbon dioxide. In the method disclosed by Chao et al., the substrate is placed in a cleaning chamber filled with the liquified gas, and a sonicating horn or similar cavitation-producing means is used to cavitate the liquified gas for a sufficient time to remove undesired material from the substrate. In one embodiment of Chao et al., the liquified gas is simply purged after the cleaning process is complete. In another embodiment, a closed loop is specified, such that all of the liquified gas is recirculated after first being purified by either vaporization, filtration, or an undefined combination of the two.

Rather than using liquified gas solvent, U.S. Pat. No. 5,013,366 issued to Jackson et al. is directed to a process for removing two or more contaminants from a substrate using phase shifting of dense gases. Specifically, Jackson et al. disclose storing a substrate in a pressure vessel filled with a liquified gas, and then varying the temperature within the vessel to shift the liquified gas between a liquid state and a supercritical state. The contaminated liquified gas is then exhausted to a separator and recycled to the vessel for repeated use. However, the structure and operation of the separator are not described.

Also issued to Jackson et al., U.S. Pat. No. 5,213,619 discloses a process for cleaning and sterilizing a material using one or more dense fluids mixed with chemical agents, and simultaneously subjected to both a high energy source of acoustic radiation and a nonuniform electrostatic energy field. No solvent purification method appears to be disclosed.

U.S. Pat. No. 5,267,455 and PCT publication WO 94/01613 to Dewees et al. are directed to a dry cleaning system that uses supercritical carbon dioxide for cleaning clothing. Once cleaning is accomplished by agitation within a vessel, all of the supercritical carbon dioxide within the vessel is drained to a vaporizer vessel for removal of entrained contaminates and then condensed for reuse.

U.S. Pat. No. 5,279,615 issued to Mitchell et al., as well as related foreign patent applications by the same inventors, are also directed to a method of cleaning fabric using dense carbon dioxide. Mitchell et al. further require the use of a nonpolar cleaning adjunct, however, to clean the fabric. After cleaning, the dense carbon dioxide is simply directed to an expansion vessel so that the extracted soils can be collected, while the carbon dioxide is apparently vented.

U.S. Pat. No. 5,313,965 issued to Palen is directed to a continuous cleaning system using a supercritical fluid. The system disclosed by Palen includes a main processing vessel having an entry airlock and an exit airlock. In this manner, purging of the supercritical fluid and decompression of the main processing vessel are not required. Although Palen states that the contaminated supercritical fluid may be processed in a conventional separator or recovery unit, no description of such separator or unit is provided.

Other patent publications that disclose cleaning processes using dense fluids include German patent application DE 3,904,514 and German patent DE 4,004,111. Both foreign publications disclose, among other things, purification by vaporization of all of the contaminated dense fluid prior to reuse.

As evident from the related art, conventional cleaning methods often require that the substrate to be cleaned is held within a bath of pressurized liquid or dense fluid solvent for a specific duration. This method may lead to recontamination of the substrate and degradation of efficiency since the contaminated solvent is not continuously purified or removed from the system.

Additionally, after cleaning is complete, conventional methods typically either vent all of the contaminated solvent to atmosphere or recycle 100% of the contaminated solvent-for reuse after purification, such as by filtering or sequentially evaporating and condensing all of the solvent. It is believed, however, that efficiency is further degraded in each of these conventional cleaning methods. This is because it is costly to constantly replace or evaporate and condense all of the solvent that is used. The conventional methods of venting or evaporating and condensing all of the solvent also result in a complete loss of all co-solvents and additives that are used in the cleaning process, which further increases costs. With regard to the use of filtration alone, it is well known that this process allows soluble impurities to pass through the system and recontaminate the substrate.

There thus remains a need for an efficient and economic method and system for continuously rejuvenating pressurized liquid or dense fluid solvents that are used for cleaning fabrics, delicate electronic components, and similar sensitive substrates, without adversely impacting the environment or wasting expensive co-solvents and additives.

SUMMARY OF THE INVENTION

The purpose and advantages of the present invention will be set forth in and apparent from the description that follows, as well as will be learned by practice of the invention. Additional advantages of the invention will be realized and attained by the methods and systems particularly pointed out in the written description and claims hereof, as well as from the appended drawings.

To achieve these and other advantages and in accordance with the purpose of the invention, as embodied and broadly described, the invention includes a method of continuously rejuvenating a pressurized liquid or dense fluid solvent used in cleaning a substrate, wherein the solvent is contaminated after contacting the substrate within a pressurized vessel. The term "dense fluid" is widely understood to refer to a gas or gas mixture that is compressed to either subcritical or supercritical conditions so as to achieve a liquid or a supercritical fluid having a density approaching that of a liquid. Hereinafter, the term "pressurized fluid solvent" will refer to both pressurized liquid and dense fluid solvents. Preferably, the pressurized fluid solvent used by the present invention is an inorganic substance, particularly carbon dioxide.

The method of the present invention includes the step of cycling a primary flow of the pressurized fluid solvent from the pressurized vessel through at least one filter to remove contaminants from the pressurized fluid solvent in the primary flow, and then cycling the primary flow back to the pressurized vessel after passing through the filter. Preferably, the primary flow of pressurized fluid solvent is cycled through a prefilter and a first filter to remove insoluble contaminants, as well as through an adsorption filter to remove soluble contaminants.

In addition to and in combination with the cycling step, a relatively small secondary flow, which may be either uniform or variable in rate, of the pressurized fluid solvent is directed from the pressurized vessel to an evaporator to evaporate the pressurized fluid solvent of the secondary flow into a vapor and separate substantially all of the contaminants therefrom. Preferably, the pressurized fluid solvent is evaporated by altering the temperature within the evaporator, although it also may be necessary to vary the pressure within the evaporator particularly if the pressurized fluid solvent is at either the subcritical or supercritical condition prior to evaporation.

The secondary flow may be obtained directly from the pressurized vessel in one aspect of the invention, or the secondary flow may be obtained from a portion of the primary flow either before or after passing through the filter in another aspect of the invention. The volume of the secondary flow, which may be varied depending upon the needs of the cleaning process, is small relative to the total volume of pressurized fluid solvent in the pressurized vessel and primary flow line so as to reduce costs and conserve materials. This is generally accomplished by maintaining the secondary flow of pressurized fluid solvent equivalent to less than 40% of the primary flow, although a range between 2% and 25% is preferred and a range between 5% and 20% is even more preferred.

In one embodiment of the invention, the vapor from the evaporator is liquified to create purified pressurized fluid solvent substantially free of contaminants, and then redirected to the pressurized vessel for further use. Particularly, the vapor is liquified to either the liquid state or to either subcritical or supercritical conditions by altering the temperature, and possibly the pressure, of the vapor as necessary. The vapor also may be liquified by altering the pressure alone. Alternatively, and in accordance with another embodiment of the invention, the vapor is vented to an outside location and new pressurized fluid solvent is replaced into the pressurized vessel at a flow substantially equivalent to the amount vented. The separate steps of venting and liquifying the vapor from the evaporator also may be performed simultaneously in another embodiment of the invention.

The invention also includes a system for performing the various steps of the method summarized above and described in detail below. Various elements of the system include, among other things, a pressurized vessel for containing the substrate to be cleaned and a volume of the pressurized fluid solvent; a primary flow line for cycling a primary flow of the pressurized fluid solvent therethrough; at least one filter positioned along the primary flow line to remove contaminants from the pressurized fluid solvent of the primary flow; and a secondary flow line having an evaporator to evaporate a secondary flow of the pressurized fluid solvent into a vapor and separate contaminants therefrom. The secondary flow line may be in fluid communication with the pressurized vessel either directly by extending from the pressurized vessel, or indirectly by extending from the primary flow line at a location either before or after the filter.

Additionally, the system of the invention includes either a compressor or a condenser to liquify the vapor from the evaporator so as to create rejuvenated pressurized fluid solvent for further use in the pressurized vessel, or a vent to selectively vent the vapor from the evaporator to a location outside the system. In the preferred embodiment of the invention, the system is provided with both a condenser and a vent connected in parallel. Rather than providing the condenser as a separate component, however, the evaporator and condenser may be provided as an integral unit, preferably including a heat exchanger and pressure regulator for both evaporating and liquifying the pressurized fluid solvent. In this manner, separate outlets would be provided for venting the vapor or discharging the rejuvenated pressurized fluid solvent, respectively.

A source of new pressurized fluid solvent is also provided for initially charging the pressurized vessel, as well as for replacing new pressurized fluid solvent into the pressurized vessel at a flow substantially equivalent to the flow of pressurized fluid solvent that is removed by the secondary flow line and vented. This source may include supply tank of fresh pressurized fluid solvent, or a storage tank of rejuvenated pressurized fluid solvent, or a combination of the two. Additionally, pressure equalization lines are provided between the storage tank and various system components to prevent the need for bleeding and cooling when these various system components are drained. The pressure equalization lines allow solvent vapor from the storage tank to replace pressurized fluid solvent that is drained from the system components, and conversely, allow the solvent vapor from the system components to cycle back to the storage tank when these system components are refilled with pressurized fluid solvent.

It is to be understood that both the foregoing general description and the following detailed description are exemplary and are intended to provide further explanation of the invention claimed.

The accompanying drawing, which is incorporated in and constitutes part of this specification, is included to illustrate and provide a further understanding of the method and system of the invention. Together with the description, the drawing serves to explain the principles of the invention.

DETAILED DESCRIPTION OF THE PREFERRED EMBODIMENT

Figure 1:
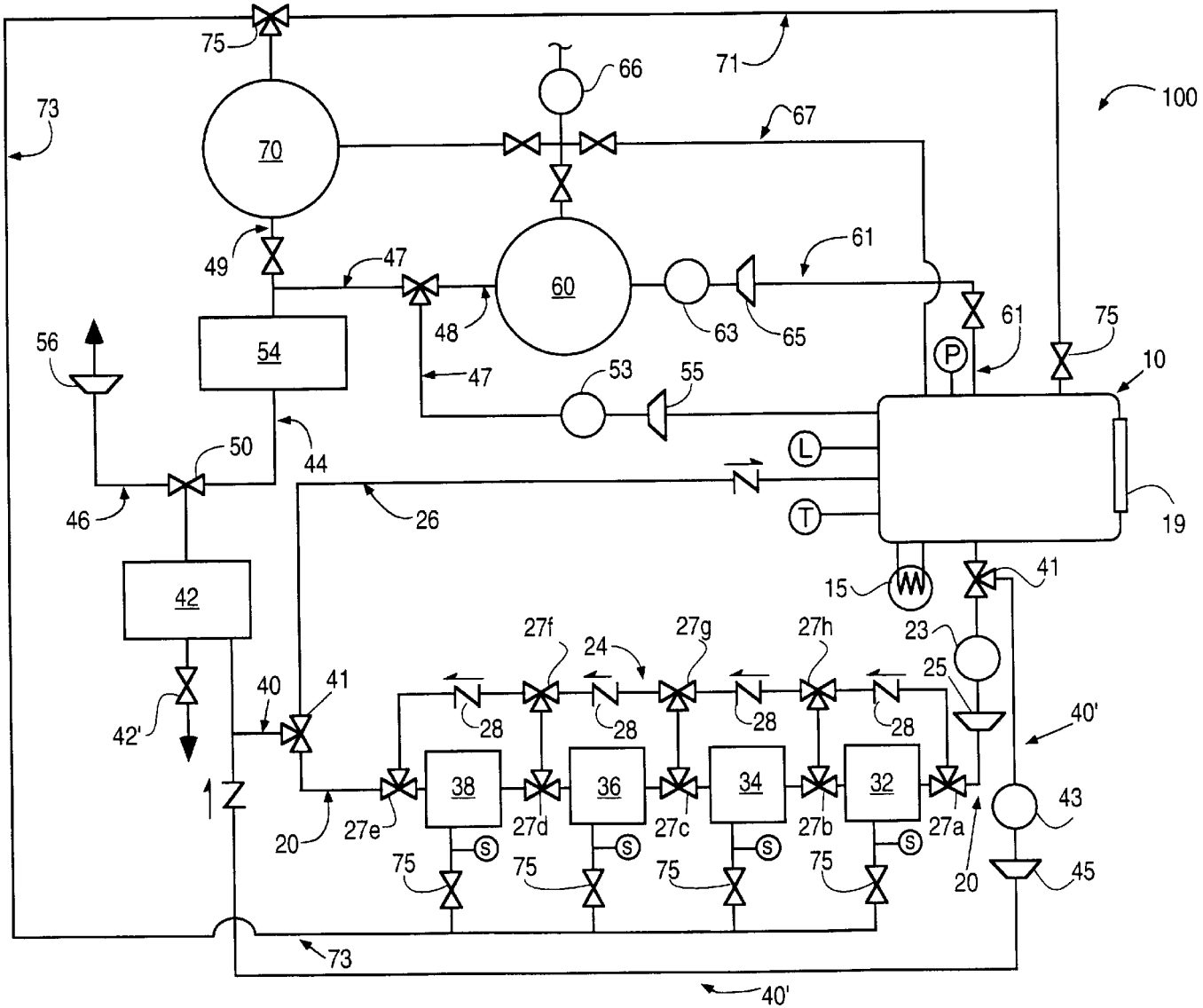
FIG. 1 is a schematic representation of the system for cleaning a substrate in accordance with the invention.

Reference will now be made in detail to the present preferred embodiments of the invention, examples of which are illustrated in the accompanying drawings. The steps of each method for cleaning the substrate and rejuvenating the pressurized fluid solvent that is used will be described in conjunction with the detailed description of the system.

The methods and systems presented herein may be used for cleaning a variety of substrates. The present invention is particularly suited for cleaning substrates such as fabrics, electronic components, and other flexible, delicate, or porous structures that are sensitive to soluble and insoluble contaminants. Of course, other more durable substrates may also be cleaned by the present invention. For purpose of explanation and illustration, and not limitation, an exemplary embodiment of a system for cleaning such substrates in accordance with the invention is shown in FIG. 1 and is designated generally by reference character 100.

As shown in FIG. 1, the system 100 generally comprises a pressurized vessel 10, a primary flow line 20 including one or more filters, and a secondary flow line 40 including an evaporator 42. The term "line" used herein is understood to refer to a piping network or similar conduit capable of being pressurized and conveying a fluid. Downstream of the evaporator 42, a condenser 54 or a vent 56 or a combination of the two is provided. For purpose of illustration and clarity, the system shown in FIG. 1 includes both the condenser 54 and the vent 56, connected in parallel by a valve 50 for selective operation of each. Alternatively, the evaporator 42 and the condenser 54 may be provided as an integral unit capable of both evaporating and liquifying the pressurized fluid solvent. In this manner, the integral unit would be positioned at the location of the valve 50, as shown in FIG. 1, and include one outlet directed to the vent 56 and another outlet directed toward return line 47.

The system 100 also includes a supply tank 60 of pressurized fluid solvent for initially charging the system 100, and for replacing pressurized fluid solvent into the pressurized vessel 10 that is removed during operation, as will be described in greater detail below. A storage tank 70 is also provided to receive rejuvenated pressurized fluid solvent from the condenser 54 during operation, as well as to receive pressurized fluid drained from the pressurized vessel 10 when necessary. Pressure equalization lines 71 and 73 extend from the storage tank 70 to the pressurized vessel 10 and to the filters along the primary flow line 20, respectively.

The solvent that is provided by the supply tank 60 and used for cleaning the substrate preferably is a pressurized liquid or dense fluid. As noted above, the term "dense fluid" is widely understood to refer to a gas or gas mixture that is maintained at either subcritical or supercritical conditions so as to achieve a liquid or a supercritical fluid having a density approaching that of a liquid. As further noted above, the term "pressurized fluid solvent" is used herein to refer to either pressurized liquid or dense fluid solvents. Although a variety of solvents may be used, it is preferred that an inorganic substance such as carbon dioxide, helium, argon, or nitrous oxide is selected for use as the pressurized fluid solvent. For cost and environmental reasons, liquid, supercritical, or subcritical carbon dioxide is selected in the preferred embodiment of the invention. The selected pressurized fluid solvent also must be compatible with the substrate being cleaned.

To maintain the solvent in the appropriate fluid state, the internal temperature and pressure of the system must be appropriately controlled relative to the critical temperature and pressure of the solvent. For example, the critical temperature and pressure of carbon dioxide is 32 degrees Celsius and 72.9 atmospheres, respectively. This may be performed in a conventional manner, such as by using a heat exchanger 15 in combination with a thermocouple T or similar register to control temperature. Likewise, pressurization of the system 100 may be performed using a pressure regulator 65 to regulate the pressure inherently provided by the supply tank 60, as well as by providing a pump 63 in combination with a pressure gauge P. The locations and number of thermocouples T and pressure gauges P shown in FIG. 1, as well as the locations and number of valves to be described below, are provided merely for the purpose of illustration and not limitation.

The system temperature and pressure may be monitored and controlled either manually, or by a conventional automated controller (not shown) that receives signals from the thermocouple T and pressure gauge P, and then sends corresponding signals to the heat exchanger 15 and pump 63, respectively. Unless otherwise noted, the temperature and pressure is appropriately maintained throughout the system 100 during operation. As such, elements contained within the system 100 are constructed of sufficient size and material to withstand the temperature, pressure, and flow parameters required for operation, and may be selected from any of a variety of conventional hardware that is available.

As well as charging or filling the system with the pressurized fluid solvent, additional co-solvents, detergents, or other conventional additives may be combined with the pressurized fluid solvent to enhance the cleaning capability of the system 100. These additives may be premixed with the pressurized fluid solvent in the supply tank 60, or as shown in FIG. 1, they may be injected intermittently or continuously by a pump 66 through injection lines 67 into the tanks 60 and 70 or the pressurized vessel 10. Hereinafter, the term "pressurized fluid solvent" will be further understood as inclusive of any additives that may have been provided.

The substrate to be cleaned is placed within the pressurized vessel 10 through vessel door 19. This may be performed prior to charging or filling the system 100 with the pressurized fluid solvent. Preferably, however, valves are provided to purge and seal off the pressurized vessel 10 so that the substrate may be loaded and unloaded without depressurizing the remainder of the system 100. Alternatively, the pressurized vessel 10 may include an entry airlock (not shown) to allow loading and unloading of substrates without purging the pressurized vessel 10. In any event, the pressurized vessel should be configured and constructed to withstand operating pressures between about 5.5 and about 10.5 MPa (i.e., from about 800 psig to about 1500 psig).

To clean the substrate, the pressurized vessel 10 is filled with the pressurized fluid solvent from either the supply tank 60 or the storage tank 70. The pressurized fluid solvent is maintained at an appropriate level in the pressurized vessel 10 throughout the cleaning operation by a level controller L. The level controller L sends a signal to the controller (not shown), which controls pump 63 and regulator 65 to regulate the outflow of solvent from the supply tank 60. Alternatively, or in addition to using the supply tank 60, rejuvenated pressurized fluid may be provided from storage tank 70 by pump 53 and regulator 55 through return line 47. If pumps 53 and 63 are reversible, then lines 47 and 61 may be used for purging or draining the pressurized vessel 10 as well. A direct line (not shown) between the storage tank 70 and pressurized vessel 10 also may be provided if desired.

Once the pressurized fluid solvent contacts the substrate within the pressurized vessel 10, contaminants from the substrate become entrained in and contaminate the solvent. As such, and in accordance with the present invention, the pressurized fluid solvent is continuously rejuvenated to remove soluble and insoluble contaminants and prevent recontamination of the substrate. This is performed efficiently and effectively by a novel combination of filtration, adsorption, and evaporation, as will be described.

Specifically, and in accordance with the present invention, a primary flow of the pressurized fluid solvent is cycled from the pressurized vessel through at least one filter to remove contaminants from the pressurized fluid solvent in the primary flow. As shown in FIG. 1 and embodied herein, a conventional pump 23 and regulator 25 are provided to cycle the primary flow of pressurized fluid solvent through a primary line 20. The required flow rate of the primary flow will vary depending upon the total volume of the system and the quantity and type of insoluble contaminants present. The filtration process to be described is preferably performed continuously throughout the cleaning process to prevent recontamination of the substrate being cleaned in the pressurized vessel 10.

Although FIG. 1 shows a series of filters positioned along the primary flow line 20, it is possible that the use of only one filter may be adequate to remove contaminants from the pressurized fluid solvent. In the preferred embodiment, however, the system includes a prefilter 32, a first filter 34, and an adsorption filter 36, and perhaps even a polishing filter 38. The use of several filters connected in series, as shown in FIG. 1, enhances the transfer and removal of contaminants from the pressurized fluid solvent of the primary flow.

The prefilter 32 is provided for the removal of larger insoluble contaminants that would likely degrade subsequent filtration. To accomplish this, the prefilter 32 preferably is constructed of woven nylon or other material not adversely affected by the solvent, co-solvent, and other additives, and has a mesh size of between about 50 and 100.

Positioned downstream of the prefilter 32 along the primary flow line 20 is a first filter 34 for the removal of additional insoluble contaminants that are entrained within the primary flow of pressurized fluid solvent. This filter 34 preferably has a particle retention capability of between about 5 and 50 microns, depending upon the requirements of the system 10. A cartridge filter having a suitable septum, such as paper, polypropylene, glass, or similar non-woven substrate is preferred for filter 34, although a diatomaceous earth filter or a powderless filter with an appropriate septum likewise may be used. If necessary or desired, additional filters of similar or finer mesh than that of first filter 34 may be provided downstream of filter 34 for enhanced filtration of insoluble contaminants. Alternatively, or additionally, a centrifuge may be provided to separate insoluble particles from the pressurized fluid solvent. Such centrifuges are conventional and known in the art.

The preferred embodiment shown in FIG. 1 also includes an adsorptive filter 36 positioned downstream of the first filter 34, as noted above. The adsorptive filter 36 is used for the control and removal of undesirable soluble contaminants, such as fugitive dyes obtained from clothes or other substrates during the cleaning process. Generally, adsorbents that may be used include activated carbon, clay, or a combination of the two. Alternative adsorbents likewise are widely known, and may be selected to satisfy the specific soluble contaminants expected to be encountered.

A polishing filter 38 also may be positioned along the primary flow line 20 if desired, or if required due to the sensitive nature of the substrate. The polishing filter 38 is provided for the removal of any fine insoluble contaminants that either bypass or are not filtered by the prefilter 32 and first filter 34, as well as for the removal of any adsorbents that may be released inadvertently by the adsorptive filter 36. The preferred construction of the polishing filter 38 is a string wound filter or microporous cartridge filter having a particle retention capability of about 1 micron.

For enhanced versatility, the preferred embodiment of the system also includes bypass line 24 connected by bypass valves 27*a*–27*e* for selectively or automatically bypassing one or more of the filters when desired or when extensive filtration is deemed unnecessary. Check valves 28 are provided to ensure that flow is not reversed through the bypass line 24. FIG. 1 shows, for purpose of illustration and not limitation, that each one or any combination of the filters may be bypassed selectively by proper operation of bypass valves 27*a*–27*e*. For example, if adsorption is not desired, filter 36 effectively can be removed from the system 100 by operation of the bypass valves 27*c*, 27*g*, 27*f*, and 27*d*. The primary flow would therefore be cycled from valve 27*a* through elements 32, 27*b*, 34, 27*c*, 27*g*, 27*f*, 27*d*, 38, and 27*e*, in order. Alternative bypass configurations likewise may be used.

After passing through the filters, the primary flow of pressurized fluid solvent is cycled back to the pressurized vessel 10 through return line 26. Filtration along the primary flow line should therefore be established, by selecting the proper filters, so as to reduce the quantity of contaminants in the pressurized fluid solvent to a level sufficient to preclude redeposition of contaminants onto the substrate when the pressurized fluid solvent is reintroduced into pressurized vessel 10 via return line 26. Although not shown, an auxiliary line also may be provided to direct the filtered pressurized fluid solvent to the storage tank 70. In this manner, the primary flow would be cycled back to the pressurized vessel 10 via the storage tank 70.

Further in accordance with the present invention, the methods and systems for rejuvenating pressurized fluid solvent include directing a secondary flow of the pressurized fluid solvent from the pressurized vessel to an evaporator to evaporate the pressurized fluid solvent of the secondary flow into a vapor and separate contaminants therefrom. The secondary flow may be either uniform or variable in rate during operation as will be described. Any soluble or insoluble contaminants entrained in the pressurized fluid solvent of the secondary flow are thus separated as a residue, which is easily collected in a conventional manner. Evaporation therefore further aids in maintaining the quantity of contaminants in the pressurized fluid solvent within an acceptable level.

The volume of pressurized fluid solvent directed to the secondary flow is small, and varied depending upon need, relative to the total volume of pressurized fluid solvent contained within the pressurized vessel and the primary flow line, including filters 32, 34, 36, and 38. In this manner, the costs associated with evaporation, and subsequent venting or liquification as will be described, are maintained low. Further, materials such as pressurized fluid solvent, co-solvents, and other additives used during the cleaning process are conserved to reduce costs and adverse environmental effects. To ensure that only a relatively small volume of pressurized fluid solvent is evaporated, the secondary flow that is directed to the evaporator is maintained equivalent to less than about 40% of the primary flow, although a range of between about 2% and 25% is preferred, and a range of between about 5% and 20% is even more preferred. This flow may be maintained uniform throughout operation for continuous rejuvenation, or may be variable in either an intermittent or a continuous manner if desired.

The system 100 embodied herein is provided with a secondary flow line in fluid communication with the pressurized vessel 10 to direct the secondary flow of pressurized fluid solvent to the evaporator 42. The secondary flow line preferably is connected to the primary flow line 20 at a location either downstream or upstream of the filter or filters by a splitter valve 41 so as to reduce the number of required penetrations through the wall of the pressurized vessel 10. Alternatively, the secondary flow line may be connected directly to the pressurized vessel 10 if desired.

In the preferred embodiment of the invention, FIG. 1 shows that a secondary flow line 40 is connected downstream of the filters, and an additional secondary flow line 40' is connected upstream for greater versatility. Thus, filtered solvent may be obtained for evaporation through secondary flow line 40, while unfiltered solvent may be obtained through secondary flow line 40'. The secondary flow may be either uniform or variable in rate, depending upon the amount of rejuvenation required, and is controlled by the splitter valves 41 in combination with the pumps and regulators located along the secondary flow lines 40, 40'.

A variety of evaporator configurations and designs are available for use in the system of the present invention. For example, evaporation can be performed by adjusting the temperature within the evaporator 42, or by adjusting the pressure within the evaporator 42, or by a combination of the two. The evaporator 42 therefore preferably includes a heat exchanger in combination with a pressure regulator to evaporate the pressured fluid solvent into a vapor or gas state, and thus separate substantially all of the contaminants therefrom. For example, if the pressurized fluid solvent is initially a pressurized liquid, then evaporation may be performed by increasing the temperature within the evaporator while maintaining a constant pressure. If the pressurized fluid solvent is a dense fluid in either the subcritical or supercritical conditions, then the pressure within the evaporator also will need to be adjusted to obtain the desired vapor or gas state while the temperature is adjusted accordingly.

The heat exchanger of the evaporator 42 may be a heat pump configuration, a combination of heating and cooling coils, or any other conventional temperature control device. Likewise, the pressure regulator of the evaporator may be a conventional pressure control valve, although the preferred embodiment also includes a compressor pump for increasing pressure within the evaporator as necessary. A thermocouple and pressure gauge also are provided for monitoring the operation of the evaporator 42. Additionally, a waste discharge line 42' or similar means is provided for removing the contaminates that are separated from the solvent after evaporation occurs. Evaporators including these features are conventional in design, and generally available so as to withstand the expected pressures and temperatures related with the system 100. Operation of the evaporator 42 may be controlled manually, or by a conventional automated controller (not shown) that receives signals from the thermocouple and pressure gauge.

Once the pressurized fluid solvent is evaporated, several options are available. In accordance with one embodiment of the invention, a condenser 54 is provided to liquify the vapor from the evaporator 42 and create rejuvenated pressurized fluid solvent substantially free of contaminants. The term "liquify" as used herein refers to altering a vapor from a gaseous state to a liquid state or to either a subcritical or a supercritical condition. This is performed by returning the temperature and pressure parameters within the condenser to the same or similar operating parameters of the remainder of the system 100. As with the evaporator 42, the condenser 54 embodied herein therefore includes a heat exchanger and a pressure regulator to adjust temperature and pressure, respectively, as well as a thermocouple and pressure gauge to monitor and control operation. Such condensers are conventional in design and available to withstand the expected operating parameters of the system 100.

By locating the condenser 54 downstream from the evaporator 42, the pressurized fluid solvent may be rejuvenated in a continuous manner to remove soluble and insoluble contaminants and prevent recontaminating the substrate. In particular, and as shown in the embodiment of FIG. 1, the rejuvenated pressurized fluid solvent from the condenser 54 is directed through a return line 47 via pump 53 and regulator 55, if necessary, to the pressurized vessel 10 for further use. Alternatively, the rejuvenated solvent from the condenser 54 may be directed through auxiliary line 48 to the supply tank 60 or through auxiliary line 49 to the storage tank 70 for future use if desired.

Rather than using a condenser, it likewise is possible to use a compressor to liquify the vapor from the evaporator 42. Acceptable compressors are available from Blackmer Pump of Grand Rapids, Mich., or Haskel International, Inc. of Burbank, Calif. The specific compressor model is based, however, on the capacity of the evaporator 42 and the demands of the system 100.

In accordance with another embodiment of the invention, the vapor from the evaporator may be vented to a location outside the system. This is accomplished by directing the vapor through a vent line 46 to a conventional vent 56 that is open to atmosphere. If the pressurized fluid solvent selected is carbon dioxide, then venting may be preferred due to its low cost and nontoxicity. For continuous operation of the system 100, however, a source of new pressurized fluid solvent is provided in fluid communication with the pressurized vessel 10 to replace new pressurized fluid solvent into the pressurized vessel 10 at a flow substantially equivalent to that of the secondary flow which is vented. FIG. 1 shows that the source of this new pressurized fluid solvent may be either the supply tank 60 or the storage tank 70. The flow of this pressurized fluid solvent from the supply tank 60 is regulated by the pump 63 and regulator 65 along the supply line 61, while the flow from the storage tank 70 is regulated by the pump 53 and regulator 55 along return line 47. As will be appreciated, the flow of the new pressurized fluid solvent may be maintained uniform throughout operation, or may be variable in either an intermittent or continuous manner.

Preferably, and according to another aspect of the invention, the system 100 is provided with both the condenser 54 and the vent 56, which are connected in parallel by valve 50. If valve 50 is a directional valve, then either the condenser 54 or the vent 56 may be selectively operated for rejuvenation of the pressurized fluid solvent. If a splitter valve is provided as the valve 50, however, then a portion of the vapor from the evaporator may be directed to the condenser 54 to create rejuvenated pressurized fluid solvent, while any remaining portion of the vapor is vented by the vent and replaced with new pressurized fluid solvent from either the supply tank 60 or the storage tank 70.

Figure 2:
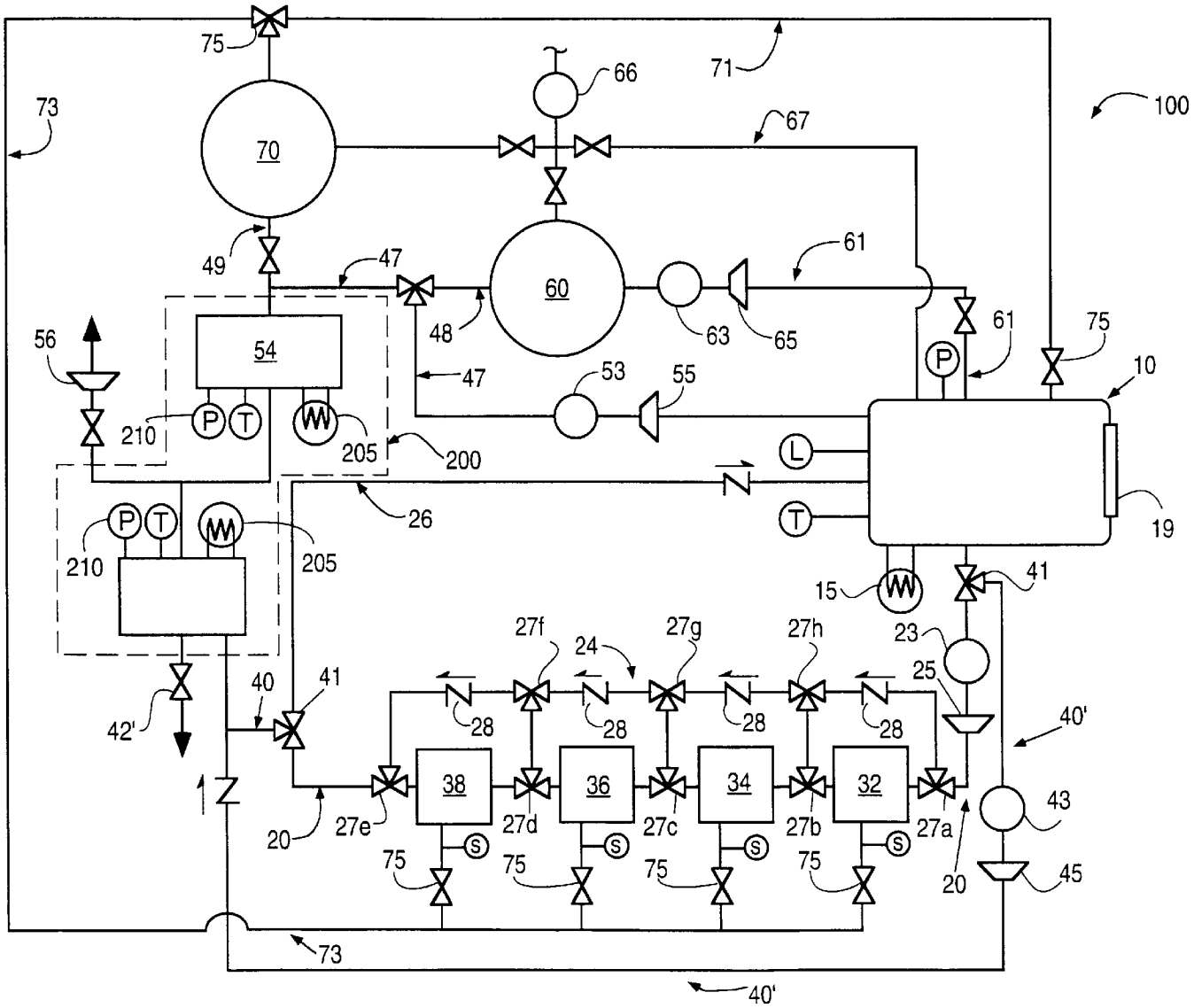
FIG. 2 is a schematic representation of the system for cleaning a substrate in accordance with the invention.

Rather than providing the evaporator 42 and the condenser 54 separately, and in accordance with yet another aspect of the invention, these two system components may be provided as an integral unit 200, as depicted in FIG. 2. This integral unit 200 would include a heat exchanger 205 and pressure regulator 21 for both evaporating and liquifying the pressurized fluid solvent as described above with regard to the separate components 42 and 54, as well as a thermocouple and pressure gauge to monitor and control operation. Rejuvenation of the pressurized fluid solvent by the integral unit 200 therefore would be performed in a batch-type operation, wherein a batch of pressurized fluid solvent from the secondary flow is first evaporated and then liquified to create rejuvenated pressurized fluid solvent. The use of an integral unit 200 is advantageous because redundant components would be eliminated, and thus, the cost of initial investment for the system would be reduced. Such integral units 200 are conventional, or may be custom made to satisfy the system requirements.

If an integral unit 200 is provided in lieu of a separate evaporator 42 and condenser 54, then the integral unit 200 would be positioned at the location of the valve 50 shown in FIG. 1. The integral unit 200 would include one outlet directed to the vent 56 and another outlet directed toward the return line 47, each outlet including a valve to control flow in accordance with the operation the integral unit 200. Particularly, if liquification is performed to create rejuvenated pressurized fluid solvent substantially free of contaminates, then the outlet directed toward the return line 47 would be opened to discharge the rejuvenated pressurized fluid solvent to either the storage tank 70 or the pressurized vessel 10. Alternatively, if venting is preferred, then the outlet directed toward the return line 47 would be closed and the outlet directed to the vent 56 would be opened once evaporation occurred.

During operation of the system 100, it may be necessary to remove or drain pressurized fluid solvent from various system components, such as the pressurized vessel 10 and the filters 32, 34, 36 and 38. Rather than venting this drained pressurized fluid solvent to atmosphere, it is preferred that the drained pressurized fluid solvent from the desired system component is directed to the storage vessel 70 for subsequent reuse. Pressure equalization lines 71 and 73 therefore are provided to prevent compression, and thus excessive heating, of the solvent vapor that is contained within the storage tank 70 as the drained pressurized fluid solvent is introduced into the storage tank 70.

Particularly, as new pressurized fluid solvent is introduced into the storage tank 70, solvent vapor is displaced through the appropriate pressure equalization line 71 and 73 to the system component that is being drained. Valves 75 are provided along the pressure equalization lines 71 and 73 to direct the solvent vapor accordingly. Conversely, when the drained system component is refilled with pressurized fluid solvent from the storage tank 70, the solvent vapor is then displaced and returned through the corresponding pressure equalization line 71 and 73 to the storage tank 70. Sight glasses or level sensors S are provided to indicate when filling is complete. Additionally, pumps (not shown) may be provided along the pressure equalization lines 71 and 73, such that solvent vapor is actively drawn from the storage tank 70 to purge pressurized fluid solvent from the system component to be drained. Although not shown, similar pressure equalization lines may be provided between the supply tank 60 and the various system components to be drained.

The methods and systems of the present invention, as described above and shown in FIG. 1, provide for continuous filtration of a primary flow of contaminated pressurized fluid solvent to remove insoluble and soluble contaminants, and for continuous evaporation of a secondary flow to enhance rejuvenation. Additionally, the system includes pressure equalization lines to prevent compression of solvent vapors, and therefore, eliminates the need for system bleeding or cooling. The present invention thus provides for the conservation of the pressurized fluid solvent, co-solvents and other additives used, as well as for the conservation of energy and time typically expended in conventional cleaning methods. Likewise, evaporator and condenser size requirements are reduced by the present invention, thereby reducing both operating and equipment costs of the system.

It will be apparent to those skilled in the art that various modifications and variations can be made in the method and system of the present invention without departing from the spirit or scope of the invention. Thus, it is intended that the present invention cover modifications and variations that come within the scope of the appended claims and their equivalents.

What is claimed is:

1. A system for cleaning a substrate using a pressurized fluid solvent, the system comprising:

a pressurized vessel capable of withstanding pressures of at least about 800 pounds per square inch and having a chamber for containing the substrate to be cleaned and a volume of the pressurized fluid solvent;

a primary flow line extending from and in fluid communication with the chamber, the primary flow line including a pump for continuously cycling a primary flow of the pressurized fluid solvent therethrough;

at least one filter positioned along the primary flow line to continuously remove contaminants from the pressurized fluid solvent of the primary flow, the primary flow line configured to cycle the pressurized fluid solvent of the primary flow back to the chamber after passing through the filter;

a secondary flow line extending from and in fluid communication with the chamber, the secondary flow line including an evaporator to evaporate a secondary flow of the pressurized fluid solvent directed through the secondary flow line into a vapor and to separate contaminants therefrom; and a condenser in fluid communication with the evaporator to liquify the vapor from the evaporator to create rejuvenated pressurized fluid solvent substantially free of contaminants, the condenser also in fluid communication with the chamber to redirect the rejuvenated pressurized fluid solvent to the chamber for further use.

2. The system of claim 1, wherein the evaporator and the condenser each include a heat exchanger for adjusting temperature respectively therein.

3. The system of claim 1, wherein the evaporator and the condenser each include a pressure regulator for adjusting pressure respectively therein.

4. The system of claim 1, wherein the evaporator and the condenser are provided together as an integral unit.

5. The system of claim 1, wherein the secondary flow line extends from and is in fluid communication with the chamber through fluid communication with the primary flow line so that the secondary flow of pressurized fluid solvent is obtained from at least a portion of the primary flow of pressurized fluid solvent.

6. The system of claim 1 further including a tank in fluid communication with the chamber for storing and supplying pressurized fluid solvent, and a pressure equalization line in fluid communication with and extending between the tank and at least one of either the filter and the chamber for displacing solvent vapor therebetween.

7. A system for cleaning a substrate using a pressurized fluid solvent, the system comprising:

a pressurized vessel capable of withstanding pressures of at least about 800 pounds per square inch and having a chamber for containing the substrate to be cleaned and a volume of the pressurized fluid solvent;

a primary flow line extending from and in fluid communication with the chamber, the primary flow line including a pump for continuously cycling a primary flow of the pressurized fluid solvent therethrough;

at least one filter positioned along the primary flow line to continuously remove contaminants from the pressurized fluid solvent of the primary flow, the primary flow line configured to cycle the pressurized fluid solvent of the primary flow back to the chamber after passing through the filter;

a secondary flow line extending from and in fluid communication with the chamber, the secondary flow line including an evaporator to evaporate a secondary flow of the pressurized fluid solvent directed through the secondary flow line into a vapor and to separate contaminants therefrom; and a compressor in fluid communication with the evaporator to compress the vapor from the evaporator to create rejuvenated pressurized fluid solvent substantially free of contaminants, the compressor also in fluid communication with the chamber to redirect the rejuvenated pressurized fluid solvent to the chamber for further use.

8. A system for cleaning a substrate using a pressurized fluid solvent, the system comprising:

a pressurized vessel for containing the substrate to be cleaned and a volume of the pressurized fluid solvent, the pressurized vessel being capable of withstanding pressures of at least about 800 pounds per square inch;

a primary flow line in fluid communication with the pressurized vessel, the primary flow line including a pump for continuously cycling a primary flow of the pressurized fluid solvent therethrough;

at least one filter positioned along the primary flow line to continuously remove contaminants from the pressurized fluid solvent of the primary flow, the primary flow line configured to cycle the pressurized fluid solvent of the primary flow back to the pressurized vessel after passing through the filter;

a secondary flow line in fluid communication with the pressurized vessel, the secondary flow line including an evaporator to evaporate a secondary flow of the pressurized fluid solvent directed through the secondary flow line into a vapor and to separate contaminants therefrom, the secondary flow line being in fluid communication with the pressurized vessel by extending from and in fluid communication with the primary flow line so that the secondary flow of pressurized fluid solvent is obtained from at least a portion of the primary flow of pressurized fluid solvent; and at least one of either (a) a condenser in fluid communication with the evaporator to liquify the vapor from the evaporator to create rejuvenated pressurized fluid solvent substantially free of contaminants, the condenser being in fluid communication with the pressurized vessel to redirect the rejuvenated pressurized fluid solvent to the pressurized vessel for further use, and (b) a vent connected in fluid communication with the evaporator to vent the vapor from the evaporator to a location outside the system, a source of new pressurized fluid solvent being provided in fluid communication with the pressurized vessel to replace new pressurized fluid solvent into the pressurized vessel.

9. A system for cleaning a substrate using a pressurized fluid solvent, the system comprising:

a pressurized vessel for containing the substrate to be cleaned and a volume of the pressurized fluid solvent, the pressurized vessel being capable of withstanding pressures of at least about 800 pounds per square inch;

a primary flow line in fluid communication with the pressurized vessel, the primary flow line including a pump for continuously cycling a primary flow of the pressurized fluid solvent therethrough;

at least one filter positioned along the primary flow line to continuously remove contaminants from the pressurized fluid solvent of the primary flow, the primary flow line configured to cycle the pressurized fluid solvent of the primary flow back to the pressurized vessel after passing through the filter;

a secondary flow line in fluid communication with the pressurized vessel, the secondary flow line including an evaporator to evaporate a secondary flow of the pressurized fluid solvent directed through the secondary flow line into a vapor and to separate contaminants therefrom;

at least one of either (a) a condenser in fluid communication with the evaporator to liquify the vapor from the evaporator to create rejuvenated pressurized fluid solvent substantially free of contaminants, the condenser being in fluid communication with the pressurized vessel to redirect the rejuvenated pressurized fluid solvent to the pressurized vessel for further use, and (b) a vent connected in fluid communication with the evaporator to vent the vapor from the evaporator to a location outside the system;

a tank in fluid communication with the pressurized vessel for storing and supplying pressurized fluid solvent to the pressurized vessel; and a pressure equalization line in fluid communication with and extending between the tank and at least one of either the filter and the pressurized vessel for displacing solvent vapor therebetween.

10. A system for cleaning a substrate using a pressurized fluid solvent, the system comprising:

a pressurized vessel having a chamber for containing the substrate to be cleaned and a volume of the pressurized fluid solvent;

a primary flow line extending from and in fluid communication with the chamber, the primary flow line including a pump for continuously cycling a primary flow of the pressurized fluid solvent therethrough;

at least one filter positioned along the primary flow line to continuously remove contaminants from the pressurized fluid solvent of the primary flow, the primary flow line configured to cycle the pressurized fluid solvent of the primary flow back to the chamber after passing through the filter;

a secondary flow line extending from and in fluid communication with the chamber and bypassing at least one filter, the secondary flow line including an evaporator to evaporate a secondary flow of the pressurized fluid solvent directed through the secondary flow line into a vapor and to separate contaminants therefrom; and a condenser in fluid communication with the evaporator to liquify the vapor from the evaporator to create rejuvenated pressurized fluid solvent substantially free of contaminants, the condenser also in fluid communication with the chamber to redirect the rejuvenated pressurized fluid solvent to the chamber for further use.

11. The system of claim 10, wherein the evaporator and the condenser each include a heat exchanger for adjusting the temperature respectively therein.

12. The system of claim 10, wherein the evaporator and the condenser each include a pressure regulator for adjusting the pressure respectively therein.

13. The system of claim 10, wherein the evaporator and the condenser are provided together as an integral unit.

14. The system of claim 10, wherein the secondary flow line extends from and is in fluid communication with the chamber through fluid communication with the primary flow line so that the secondary flow of pressurized fluid solvent is obtained from at least a portion of the primary flow of pressurized fluid solvent.

15. The system of claim 10, further including a tank in fluid communication with the chamber for storing and supplying pressurized fluid solvent, and a pressure equalization line in fluid communication with and extending between the tank and at least one of either the filter and the chamber for displacing solvent vapor therebetween.

16. A system for cleaning a substrate using a pressurized fluid solvent, the system comprising:

a pressurized vessel having a chamber for containing the substrate to be cleaned and a volume of the pressurized fluid solvent;

a primary flow line extending from and in fluid communication with the chamber, the primary flow line including a pump for continuously cycling a primary flow of the pressurized fluid solvent therethrough;

at least one filter positioned along the primary flow line to continuously remove contaminants from the pressurized fluid solvent of the primary flow, the primary flow line configured to cycle the pressurized fluid solvent of the primary flow back to the chamber after passing through the filter;

a secondary flow line extending from and in fluid communication with the chamber and bypassing at least one filter, the secondary flow line including an evaporator to evaporate a secondary flow of the pressurized fluid solvent directed through the secondary flow line into a vapor and to separate contaminants therefrom; and a compressor in fluid communication with the evaporator to compress the vapor from the evaporator to create rejuvenated pressurized fluid solvent substantially free of contaminants, the compressor also in fluid communication with the chamber to redirect the rejuvenated pressurized fluid solvent to the chamber for further use.

17. A system for cleaning a substrate using a pressurized fluid solvent, the system comprising:

a pressurized vessel for containing the substrate to be cleaned and a volume of the pressurized fluid solvent;

a primary flow line in fluid communication with the pressurized vessel, the primary flow line including a pump for continuously cycling a primary flow of the pressurized fluid solvent therethrough;

at least one filter positioned along the primary flow line to continuously remove contaminants from the pressurized fluid solvent of the primary flow, the primary flow line configured to cycle the pressurized fluid solvent of the primary flow back to the pressurized vessel after passing through the filter;

a secondary flow line in fluid communication with the pressurized vessel and bypassing at least one filter, the secondary flow line including an evaporator to evaporate a secondary flow of the pressurized fluid solvent directed through the secondary flow line into a vapor and to separate contaminants therefrom, the secondary flow line being in fluid communication with the pressurized vessel by extending from and in fluid communication with the primary flow line so that the secondary flow of pressurized fluid solvent is obtained from at least a portion of the primary flow of pressurized fluid solvent; and at least one of either (a) a condenser in fluid communication with the evaporator to liquify the vapor from the evaporator to create rejuvenated pressurized fluid solvent substantially free of contaminants, the condenser being in fluid communication with the pressurized vessel to redirect the rejuvenated pressurized fluid solvent to the pressurized vessel for further use, and (b) a vent connected in fluid communication with the evaporator to vent the vapor from the evaporator to a location outside the system, a source of new pressurized fluid solvent being provided in fluid communication with the pressurized vessel to replace new pressurized fluid solvent into the pressurized vessel.

18. A system for cleaning a substrate using a pressurized fluid solvent, the system comprising:

a pressurized vessel for containing the substrate to be cleaned and a volume of the pressurized fluid solvent;

a primary flow line in fluid communication with the pressurized vessel, the primary flow line including a pump for continuously cycling a primary flow of the pressurized fluid solvent therethrough;

at least one filter positioned along the primary flow line to continuously remove contaminants from the pressurized fluid solvent of the primary flow, the primary flow line configured to cycle the pressurized fluid solvent of the primary flow back to the pressurized vessel after passing through the filter;

a secondary flow line in fluid communication with the pressurized vessel and bypassing at least one filter, the secondary flow line including an evaporator to evaporate a secondary flow of the pressurized fluid solvent directed through the secondary flow line into a vapor and to separate contaminants therefrom;

at least one of either (a) a condenser in fluid communication with the evaporator to liquify the vapor from the evaporator to create rejuvenated pressurized fluid solvent substantially free of contaminants, the condenser being in fluid communication with the pressurized vessel to redirect the rejuvenated pressurized fluid solvent to the pressurized vessel for further use, and (b) a vent connected in fluid communication with the evaporator to vent the vapor from the evaporator to a location outside the system;

a tank in fluid communication with the pressurized vessel for storing and supplying pressurized fluid solvent to the pressurized vessel; and a pressure equalization line in fluid communication with and extending between the tank and at least one of either the filter and the pressurized vessel for displacing solvent vapor therebetween.

* * * * *